United States Patent [19]

Satoh et al.

[11] Patent Number: 5,051,011

[45] Date of Patent: Sep. 24, 1991

[54] THERMAL PRINTER WITH SHUTTER RIBBON END DETECTOR

[75] Inventors: Mitsuyoshi Satoh; Genji Oshino, both of Shibata, Japan

[73] Assignee: Tohoku Ricoh Co., Ltd., Miyagi, Japan

[21] Appl. No.: 436,553

[22] Filed: Nov. 13, 1989

[30] Foreign Application Priority Data

| | | | |
|---|---|---|---|
| Dec. 29, 1988 | [JP] | Japan | 63-171242[U] |
| Dec. 29, 1988 | [JP] | Japan | 63-334837 |
| Dec. 29, 1988 | [JP] | Japan | 63-334838 |

[51] Int. Cl.[5] ..... B41J 33/40

[52] U.S. Cl. ..... 400/219; 400/234; 400/248

[58] Field of Search ..... 400/120, 248, 234, 219, 400/219.1, 208, 208.1

[56] References Cited

U.S. PATENT DOCUMENTS

| | | | |
|---|---|---|---|
| 2,609,077 | 9/1952 | Schroeder | 400/234 |
| 2,964,157 | 12/1960 | Knight | 400/234 |
| 4,079,827 | 3/1978 | Work | 400/234 |
| 4,337,001 | 6/1982 | Cappoto | 400/208 |
| 4,350,454 | 9/1982 | Schoenlein | 400/234 |
| 4,406,553 | 9/1983 | Nally et al. | 400/208 |
| 4,422,592 | 12/1983 | Swope et al. | 400/234 |
| 4,505,605 | 3/1985 | Hasegawa et al. | 400/208 |
| 4,605,327 | 8/1986 | Ueki et al. | 400/208 |
| 4,710,044 | 12/1987 | Ackermann | 400/249 |
| 4,770,553 | 9/1988 | Deschamps | 400/234 |

FOREIGN PATENT DOCUMENTS

| | | | |
|---|---|---|---|
| 0090164 | 10/1983 | European Pat. Off. | 400/234 |
| 0194880 | 11/1984 | Japan | 400/234 |
| 0048392 | 3/1985 | Japan | 400/234 |

OTHER PUBLICATIONS

"Ribbon Drag Wire" IBM Technical Disclosure Bulletin, vol. 18, No. 4, 9/75, p. 1093.

"Ribbon Drag Cartridge with Foam Drag Element" Xerox Disclosure Journal, vol. 1, No. 2, 2/76, pp. 47–48.

"Interlock for Preventing Ribbon Break" IBM Tech. Disc. Bulletin, vol. 29, No. 7, 12/86, pp. 2849–2850.

*Primary Examiner*—Eugene H. Eickholt

*Attorney, Agent, or Firm*—Koda and Androlia

[57] ABSTRACT

A printer, such as a thermal printer, which can print on a paper, etc. The printer comprises: a supply core; a print ribbon which is wound onto the supply core; a paper which is put together with the print ribbon which is supplied from said supply core; a print head which is mounted facing a platen and prints on the paper by using said print ribbon when said paper put together with the print ribbon passes between the print head and the platen; a take-up core which pulls off the printed paper and takes up said print ribbon; a tension member which is in contact with said print ribbon between said supply core and said take-up core and biases the print ribbon in the direction to give tension and which can be rotated in the retracted direction against said biasing force by the ribbon feed force when said print ribbon having one end fastened to said supply core runs out; a shutter member which is supported with the tension member and maintained at the non-detecting position with said print ribbon when there is the print ribbon between said supply core and said take-up core and which can be moved to the detecting position when the print ribbon runs out; and a sensor which operates with a shutter member moved to the detecting position, operates with said tension member rotated in the retracted direction, and detects the ribbon end.

5 Claims, 6 Drawing Sheets

THERMAL PRINTER WITH SHUTTER RIBBON END DETECTOR

BACKGROUND OF THE INVENTION

The present invention relates to a printer, such as a thermal printer, which can print on a paper, etc.

In conventional printers, for example a thermal printer, it feeds print ribbon 2 wound on supply core 1, puts the print ribbon 2 on paper 3, and prints on paper 3 with print head 5 by using the print ribbon 2 when the paper 3 and the print ribbon 2 put together pass between platen 4 and the print head 5, as shown in FIG. 1. After that, print ribbon 2 is pulled off paper 3 and then would onto take-up core 6.

In this kind of printer, to detect the presence of print ribbon 2, a transmission-type sensor 7, for example, is conventionally provided. Sensor 7 is used to detect the end of print ribbon 2 when the end 2*a* of print ribbon 2 is separated from supply core 1 and passes through the position of the sensor 7, as shown in FIG. 2.

However, it is not possible to detect the end of ribbon with such a ribbon end detecting mechanism when print ribbon 2 having such an end 2*a* firmly fastened to core 1 is used, because the end 2*a* is not separated from supply core 1 and does not pass through the position of sensor 7 even if print ribbon 2 runs out. Therefore, even if print ribbon 2 runs out, the printing operation is not terminated and continues successively by using the same portion of print ribbon 2. For example, in a thermal printer, there are problems in which the base of print ribbon 2 melts by the heat from print head 5 and it sticks to print head 5.

Therefore, it is not possible to use print ribbon 2 having an end 2*a* firmly fastened to core 1 in the conventional printers.

In this kind of printer, drum gear 9 is conventionally engaged with friction gear 8 which is fixed to the same shaft as supply core 1 to prevent slack and wrinkles of print ribbon 2 by applying back tension, and friction member 13 which is held with holder 11 and biases with friction spring 12 is pushed against the circumference of friction drum 10 of the same shaft as drum gear 9 to apply a rotational load to supply core 1.

However, in such a back tension mechanism, the back tension which is applied to print ribbon 2 by the ribbon feed force increases when the diameter of the ribbon wound on supply core 1 becomes small, as shown in FIG. 4, although the rotational load which is applied to supply core 1 is constant. Therefore, when the rotational load is set at a large value and the diameter of a ribbon becomes small, the ribbon is not fed properly and slips, lowering the print quality, and in some cases print ribbon 2 is broken. On the contrary, when the rotational load is set at a small value and the diameter of a ribbon is large, as shown in FIG. 3, the back tension becomes insufficient, causing generation of slack and wrinkles in print ribbon 2.

Further, as shown in FIG. 5, print ribbon 2 is conventionally pulled off the printed paper 3 by release plate 14 being attached to thermal head 5, or by thermal head 5 itself without release plate 14 being attached to thermal head 5, which is different from the illustrated example of the figure, and wound onto the take-up core, which is not illustrated.

However, in such a ribbon release mechanism, the ribbon take-up force and the push-up force provided by the flexibility of paper 3, which straightens up itself, are applied to thermal head 5, and reduce the pushing force of thermal head 5 against platen 4. In case that, especially when a paper ribbon or a thick paper, such as tag paper, is used, there are problems that lower the print quality because clear transfer is not performed and because blurring occurs.

A first object of this invention is therefore to provide a printer which enables the use of not only a print ribbon without one end fastened to the supply core, but also a print ribbon having one end firmly fastened to the supply core.

A second object of this invention is to provide a printer which gives good back tension to roll materials, such as print ribbon wound on the supply core, all the time regardless of the size of the diameter of roll materials.

A third object of this invention is to provide a printer which prevents the lowering of print quality by not applying any external force, which reduces the pushing force, to the thermal head.

SUMMARY OF THE INVENTION

To achieve the first object of the present invention, the printer according to the present invention comprises a supply core, a print ribbon which is wound onto the supply core, a paper which is put together with the print ribbon supplied from the supply core, a print head which is mounted facing the platen and prints on the paper by using the print ribbon when the paper put together with the print ribbon passes between the print head and the platen, a take-up core which pulls off the printed paper and takes up the print ribbon, a tension member which is in contact with the print ribbon in between the supply core and the take-up core and biases the print ribbon in the direction to give tension and which can be rotated in the retracted direction against the biasing force by the ribbon feed force when the print ribbon having one end fastened to the supply core runs out, a shutter member which is supported with the tension member and maintained at the non-detecting position with the print ribbon when there is the print ribbon between the supply core and the take-up core and which can be moved to the detecting position when the print ribbon runs out, and a sensor which operates with a shutter member moved to the detecting position, operates with the tension member rotated in the retracted direction, and detects the ribbon end.

In case a print ribbon not having one end fastened to the supply core is used, when the print ribbon runs out, the shutter member is moved to the detecting position to operate the sensor and a ribbon end is detected. On the other hand, in case a print ribbon having one end firmly fastened to the supply core is used, when the print ribbon runs out, the tension member is rotated in the retracted direction against the force of the tension spring to bias tension to operate the sensor and a ribbon is detected.

Next, to achieve the second object, the printer according to the present invention comprises a supply core, a roll material which is wound onto the supply core, a print head which is mounted facing the platen and prints on the roll material itself or on a paper by using the roll material as a print ribbon when the roll material fed from the supply core passes between the print head and the platen, a take-up core which takes up the printed roll material, a tension member which is in contact with the roll material in between the supply core and the take-up core and biases the roll material in the direction to give tension and which is rotated in the retracted direction against the biasing force by the roll material feed force when the roll material wound on the supply core is fed, a plate spring which is supported with the tension member and gives the rotational load to the supply core by pushing the end against the supply core or a member which rotates together with it and which reduces the rotational load by making the amount of deflection small with the rotation of the tension member in the retracted direction.

The rotational load is given to the supply core with the plate spring and the tension member is rotated in the retracted direction to make the deflection amount of the plate spring small to reduce the rotational load which is applied to the supply core with the feeding of the roll material wound on the supply core.

Finally, to achieve the third object, the printer according to the present invention comprises a print ribbon, a paper put together with the print ribbon, a thermal head which is pushed against the platen and prints on the paper by using the ribbon when the paper put together with the print ribbon passes between the thermal head and the platen, and a release member, provided separately from the thermal head, which is in contact with the printed paper on the platen side of the tangent line of the platen at the printing position, conveys the paper on the platen side, and provides a release position to pull the thermal transfer ribbon off the paper.

The ribbon take-up force is supported by the release member and the push-up force by the flexibility of the paper is similarly supported by the release member so that those external forces are not applied to the thermal head.

PREFERRED EMBODIMENTS

The present invention is further explained in detail by referring to the attached drawings.

Figure 1:
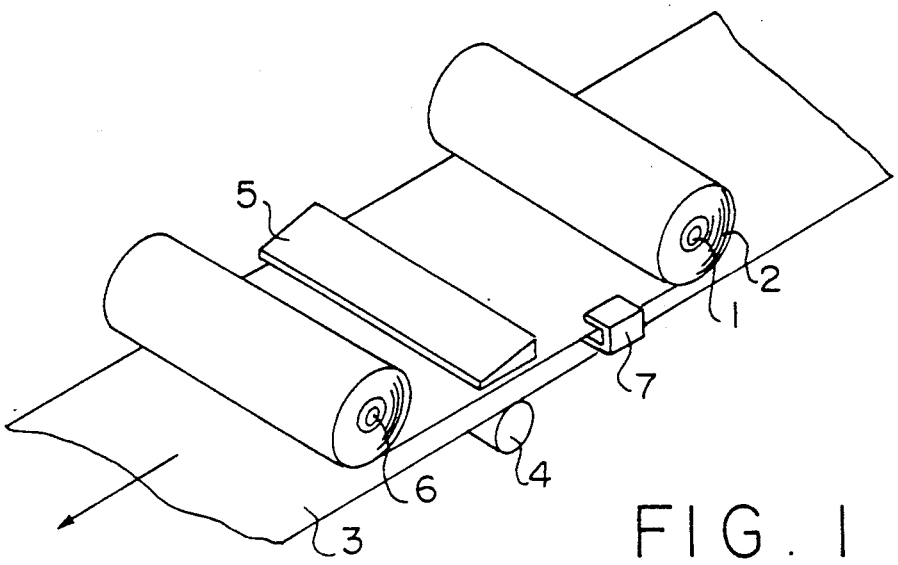
FIG. 1 is a perspective view illustrating a conventional ribbon feed mechanism in a printer.
Figure 2:
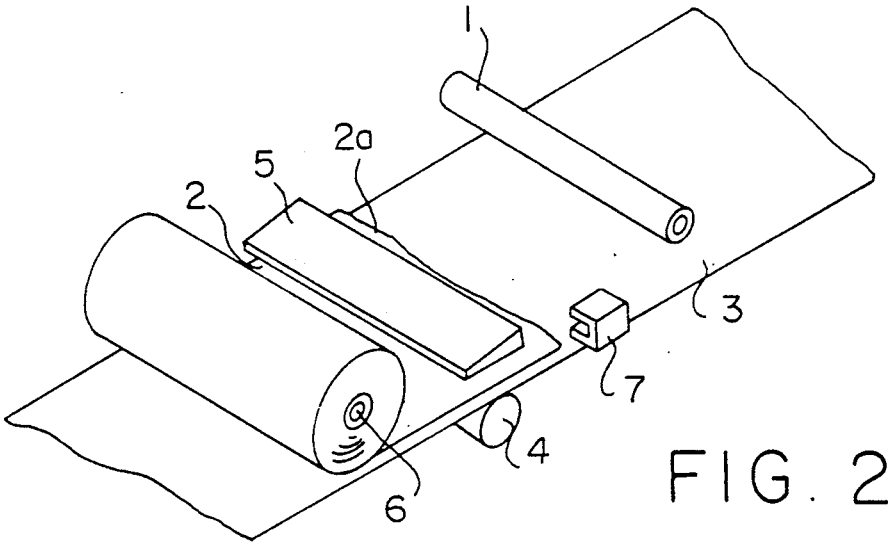
FIG. 2 is a perspective view illustrating a state of a ribbon end in the ribbon feed mechanism shown in FIG. 1.
Figure 3:
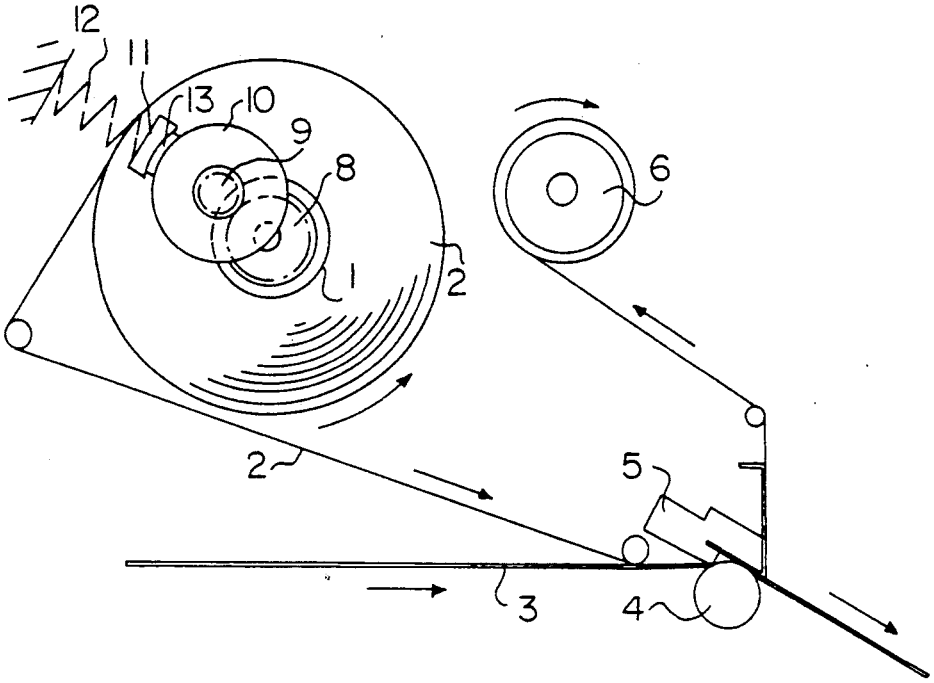
FIG. 3 is a view illustrating a conventional back tension mechanism in a printer.
Figure 4:
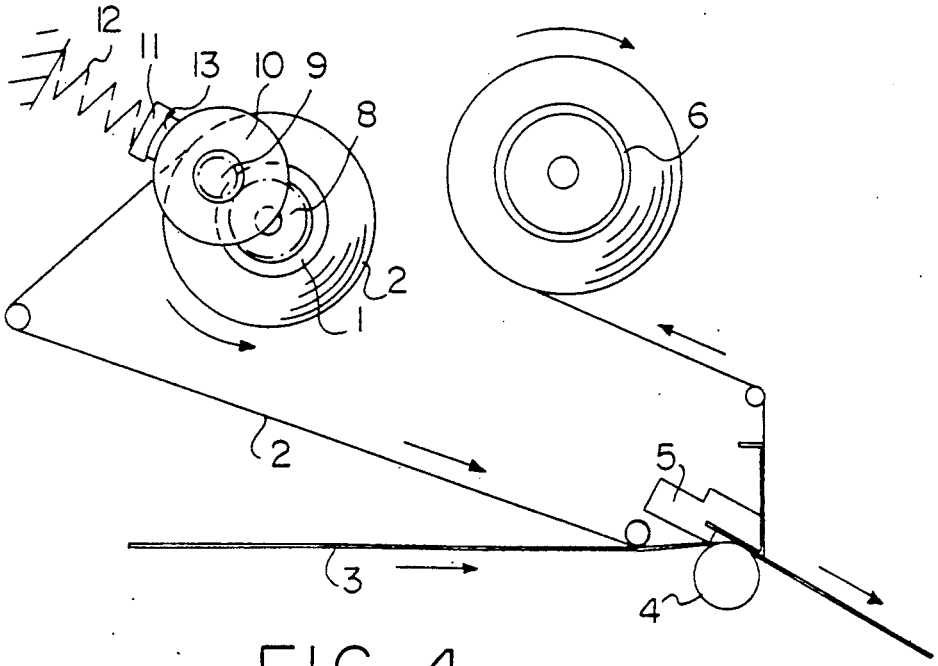
FIG. 4 is a view illustrating a state in which the diameter of a ribbon wound on a supply core becomes small in the ribbon feed mechanism shown in FIG. 3.
Figure 5:
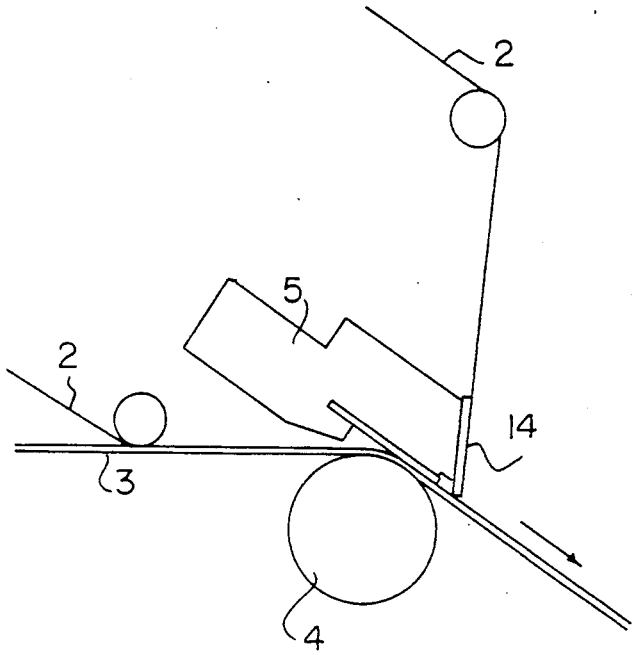
FIG. 5 is a view showing the mechanism of the area surrounding a thermal head, in a conventional ribbon release mechanism of a printer.
Figure 6:
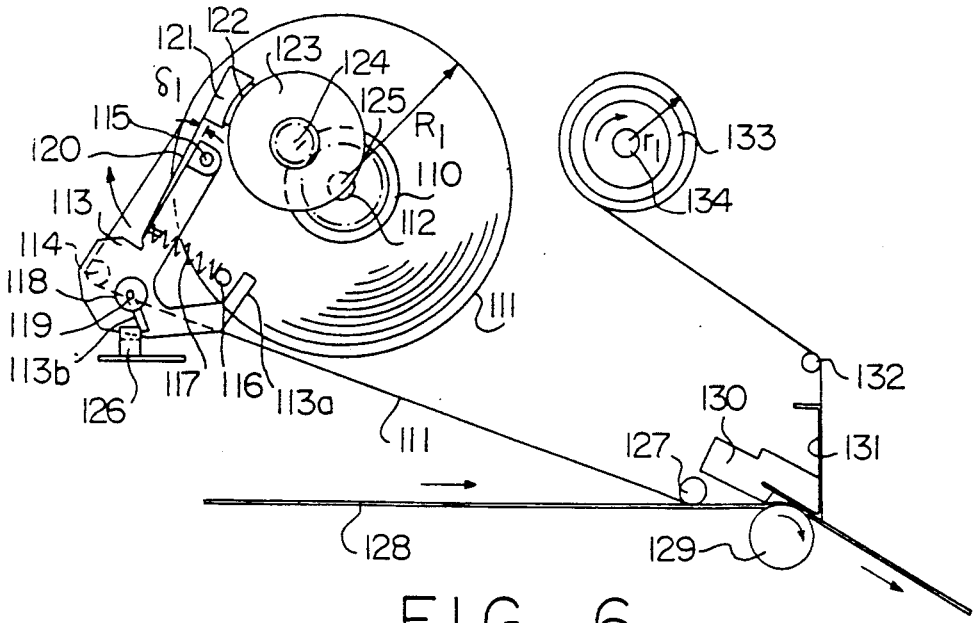
FIG. 6 is a view showing the mechanism of a ribbon feed mechanism in a thermal printer which is an embodiment of the present invention.

FIG. 6 is a view showing the mechanism illustrating a ribbon feed mechanism in a thermal printer, which is an embodiment of this invention. In the figure, 110 shows a supply core on which thermal transfer print ribbon 111 is wound. Supply core 110 is rotatably mounted on supply roller 112.

Figure 8:
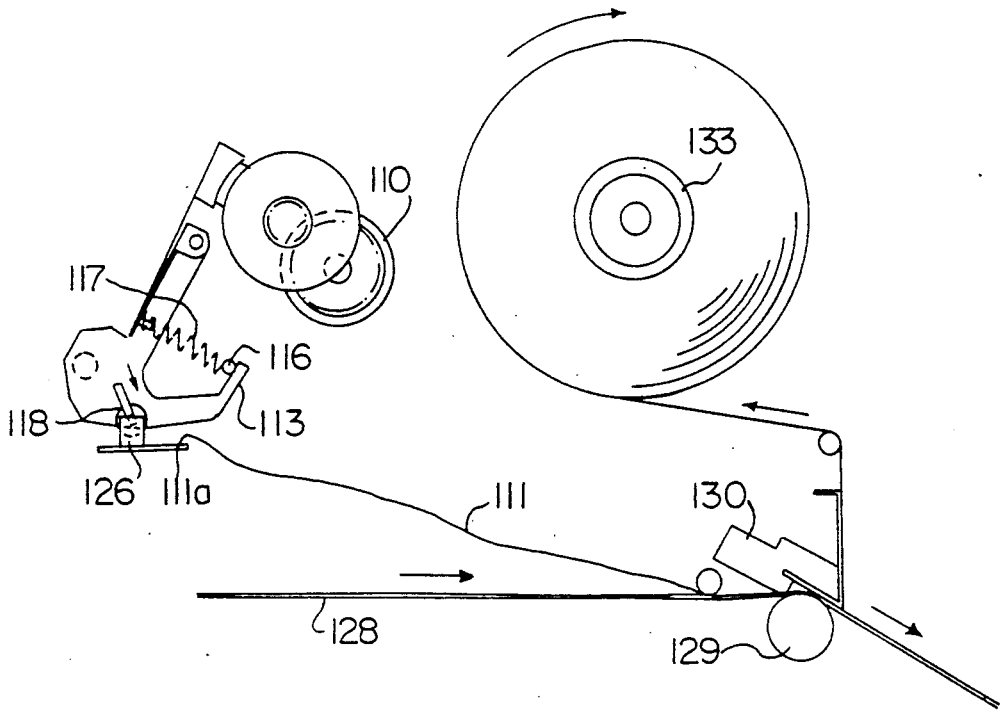
FIG. 8 is a view showing the state at the time when the print ribbon runs out, in case a print ribbon not having one end fastened to the supply core is used in the ribbon feed mechanism shown in FIG. 6 and FIG. 7.

Print ribbon 111 wound on the supply core 110 is fed and passed around tension shaft 114 of tension member 113. Tension shaft 114 is placed against tension member 113. Tension member 113 can be rotated around fulcrum shaft 115 shown in the upper portion of the figure. The tension member 113 is pushed against an end of tension spring 117 whose other end is pushed against stopper 116 for biasing and the tendency to rotate in the clockwise direction in the figure acts upon tension member 113 to apply tension to print ribbon 111. As can be understood from the figure, the tension member 113 is provided with arm **113*a* which extends from the lower portion of the tension member 113 toward right while it is provided with long groove 113*b* in the lower portion of the tension member 113 which extends upward and downward. Shutter shaft 119 of shutter member 118 is put into the long groove 113*b* so that it can be slid. The shutter member 118 is thus supported by tension member 113. When there is print ribbon 111, shutter shaft 119 is placed on the print ribbon 111, as shown in the figure, and shutter member 118 is held on long groove 113*b*, that is, at the non-detecting position shown in the figure. When there is no print ribbon 111, shutter shaft 119 falls by its own weight and moves to the lower portion of long groove 113*b*, that is, to the detecting position, which will be described later, as shown in FIG. 8**.

On the other hand, the base end of plate spring 120 is mounted on tension member 113 at the position where the other end of tension spring 117 is being pushed against. Friction material 122 is mounted on the head of plate spring 120 through holder 121 and the friction material 122 is pushed against friction drum 123 with the elasticity of plate spring 120. Friction drum 123 is provided with drum gear 124 rotating on the same shaft and drum gear 124 is engaged with friction gear 125. Friction gear 125 is fixed to the above-mentioned supply roller 112 and the load is given to the rotation of supply core 110 thereby.

Figure 10:
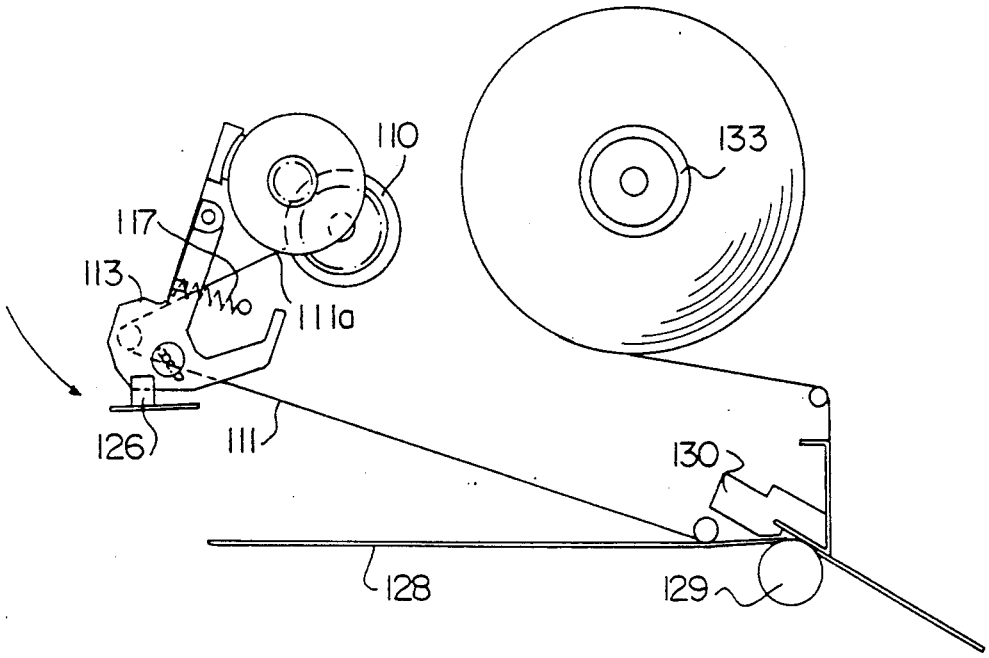
FIG. 10 is a view showing the state of the ribbon end detection after the detection shown in FIG. 9.

Sensor 126 is mounted in the lower portion in the figure, of the above-mentioned tension member 113. A transmission-type photosensor, for example, is used as sensor 126 and it is arranged so that it operates with shutter member 118 moved to the detecting position, as shown in FIG. 8. It is also arranged so that it operates with tension member 113 rotated counterclockwise (retracted direction) in FIG. 10 against tension spring 117.

As shown in FIG. 6, print ribbon 111 supplied from supply core 110 is threaded on tension shaft 114, and then threaded on guide shaft 127. It is put on paper 128 at the position of guide shaft 127, the paper 128 being conveyed from the left hand side in the figure. The paper and ribbon are then fed between platen 129 and print head 130. Platen 129 rotates in the direction of the arrow shown in the figure with a motor which is not illustrated in the figure. On the other hand, print head 130 is a conventional thermal head having a heating resistor and its heating resistor is pushed against platen 129. When paper 128 and print ribbon 111 pass between print head 130 and platen 129, printing is performed by applying current to the heating resistor to melt ink of print ribbon 111 and by transferring it to paper 128.

Print ribbon 111 after completion of printing is pulled off paper 128, conveyed upward in the figure along the vertical release plate 131, guided by guide shaft 132, and wound on to take-up core 133. Take-up core 133 is rotatably mounted on take-up roller 134. Take-up roller 134 rotates in the direction of the arrow shown in the figure with the motor which is not illustrated in the figure. As a result, paper 128 is separated from platen 129 and conveyed downward and to the right in the figure.

Figure 7:
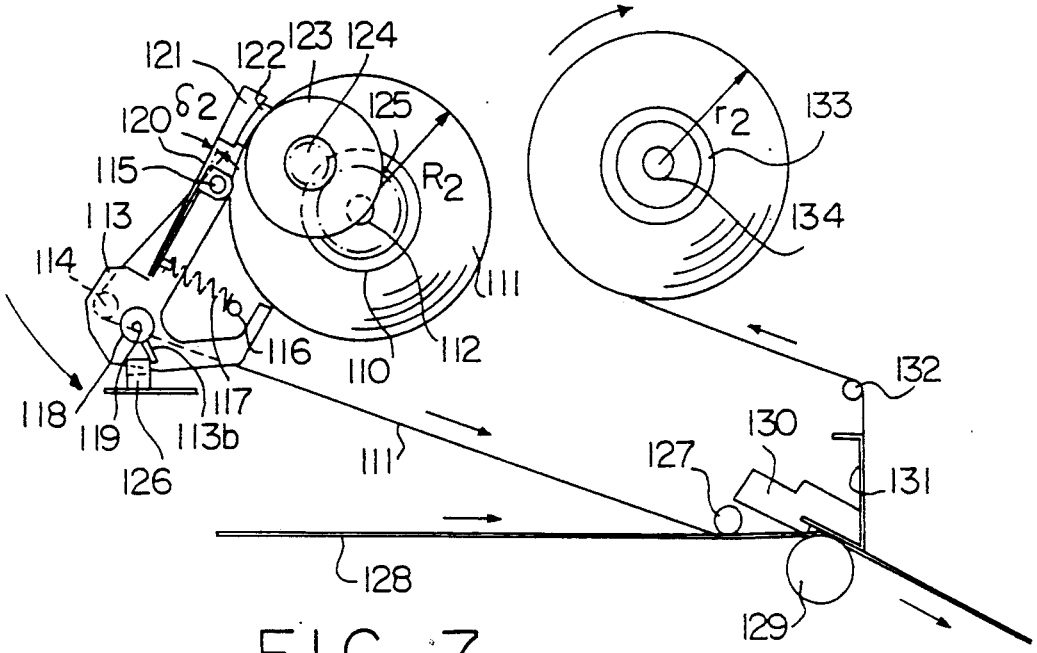
FIG. 7 is a view showing the print ribbon shown in FIG. 6 being in use.

Printing is performed successively on paper 128 with print head 130 by using print ribbon 111 at the position of platen 129 while platen 129 and take-up core 133 is rotated in the direction of the arrow shown in the figure with a motor which is not illustrated in the figure to convey print ribbon 111 and paper 128. As printing continues, the diameter of the ribbon wound on supply core 110 becomes small from $R_1$ to $R_2$ and the diameter of the ribbon which is wound onto take-up core 133 becomes large from $r_1$ to $r_2$, as shown in FIG. 7.

From the relation of force which acts on tension member 113, tension member 113 is rotated counter-clockwise in the figure by the ribbon feed force against the biasing force of tension spring 117 and the deflection amount $\delta$ of plate spring 120 becomes small from $\delta_1$ to $\delta_2$, as shown in the figure. With this, when the diameter of the ribbon wound on supply core 110 becomes small, the rotational load which is applied to it can also be reduced.

In case a print ribbon not having one end fastened to supply core 110 is used, when print ribbon 111 runs out, as shown in FIG. 8, the end 111*a* is separated from supply core 110. Tension member 113 is rotated clockwise in the figure by the biasing force of tension spring 117 and is stopped by pushing its arm 113*a* against stopper 116. Shutter member 118 falls by its own weight to the detection position shown in the figure to operate sensor 126 and the end of ribbon is detected. Also in case the end 111*a* is loosely fastened to supply core 110, when print ribbon 111 runs out, the end 111*a* is separated from supply core 110 and acts in a similar manner.

Figure 9:
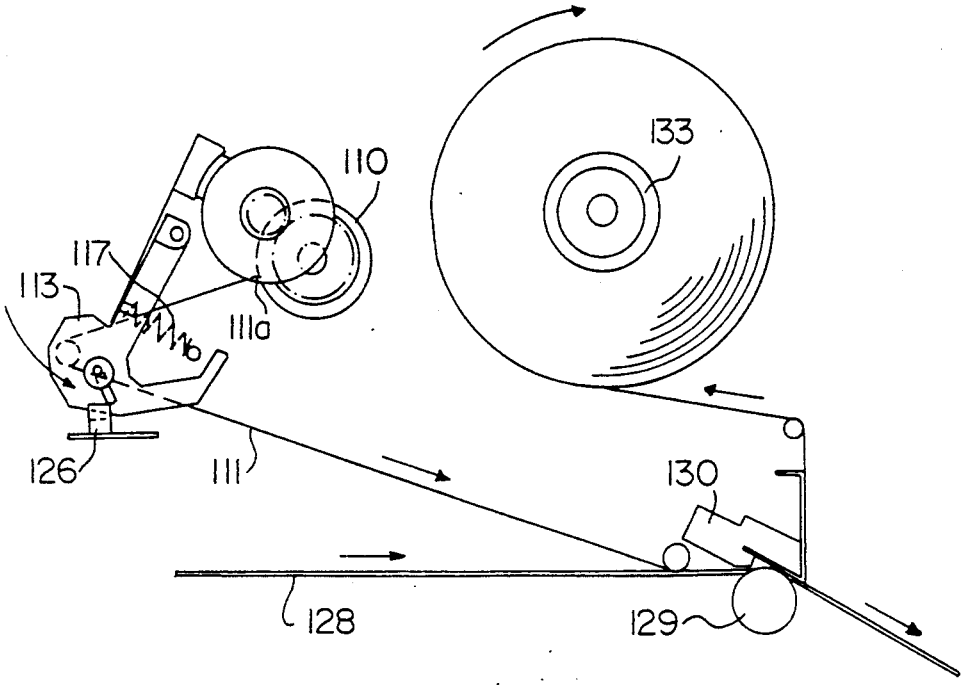
FIG. 9 is a view showing the state at the time just after the print ribbon runs out in case a print ribbon having one end firmly fastened to the supply core is used in the ribbon feed mechanism shown in FIG. 6 and FIG. 7.

On the other hand, in case print ribbon 111 having one end 111*a* firmly fastened to supply core 110 is used, the end 111*a* is not separated from supply core 110, as shown in FIG. 9, even if print ribbon 111 runs out. When the feed force is further continuously applied to print ribbon 111 in that state, tension member 113 is pulled by the print ribbon 111 and is rotated counter-clockwise (retracted direction) in the figure against the biasing force of tension spring 117 and assumes the state shown in FIG. 10. With this, sensor 126 is operated with its tension member 113 and the end of ribbon is detected. In FIGS. 6, 7, 9 and 10, the stopper 116 is separated from the arm 113*a*, while the stopper 116 and the arm 113*a* are contacted in FIG. 8. In FIGS. 6, 7, 9 and 10 is shown the state where the ribbon 111 is passed between the supply core 110 and the take-up core 133. On the other, FIG. 8 shows the state or condition when the ribbon end 111*a* of ribbon 111 is not fastened to the supply core 110 and has already separated therefrom. Furthermore, the tension member 113 is rotatable around falcrum shaft 115 and is biased to rotate in the clockwise direction by the tension spring 117 around the shaft 115. With this structure, when the ribbon 111 is not passed on the tension mechanism described above, the tension member 113 is biased in the clockwise direction around the fulcrum shaft 115 and arm 113*a* hits against stopper 116 and stops, as is shown in FIG. 8. On the other hand, as is shown in FIGS. 6, 7, 9 and 10, ribbon 111 is passed on this mechanism and as a result, the ribbon 111 receives adequate tension. Accordingly, arm 113*a* rotates in a counter clockwise direction and is separated from the stopper 116 and is balanced.

In the printer illustrated in an embodiment shown in the figures, print ribbon 111 wound on supply core 110 with the inked side out is used. However, this invention can also be applied to a printer which uses a print ribbon wound on the supply core with the inked side in. Although an embodiment shown in the figures explains a case in which this invention is applied to a thermal printer, this invention can be applied not only to the thermal printers, but also to other printers, and can also be applied not only to printers, but also to other printing devices in a similar manner.

Therefore, either a print ribbon having one end fastened to the supply core or one not having one end fastened to the supply core can be used with the ribbon end detecting mechanism illustrated in the above-mentioned embodiment. This reduces user trouble at the time of ordering print ribbons.

When the print ribbon wound on the supply core is fed, tension member is rotated in the retracted direction to reduce the amount of deflection of the plate spring and the rotational load applied to the supply core with the back tension mechanism illustrated in the above-mentioned embodiment, so good back tension is applied to the print ribbon at all times regardless of the size of the diameter of the print ribbon wound on the supply core. This prevents slipping of the print ribbon to keep the print quality and prevents breakage of the print ribbon while it prevents the occurrence of slack and wrinkles of the print ribbon caused by insufficient back tension. Although the above-mentioned embodiment shows a case in which back tension is given to print ribbon 111, this invention can be applied not only to the print ribbon illustrated in the embodiment shown in the figures, but also to the case in which the back tension is given to roll material, for example, a paper roll called a rewinder.

Figure 11:
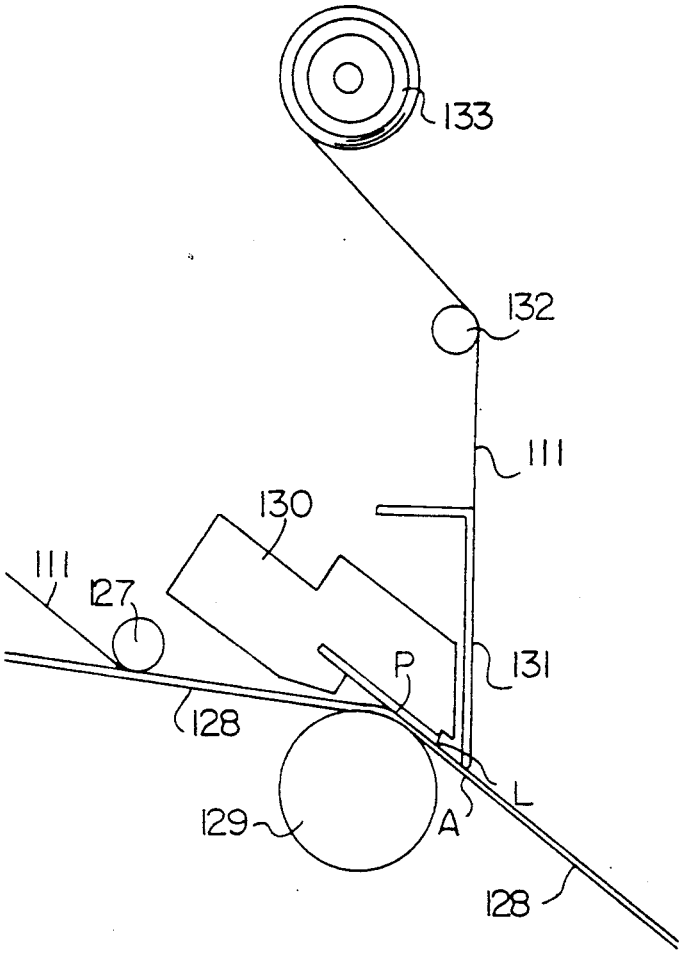
FIG. 11 is an enlarged view for showing the mechanism of the area surrounding a thermal head in order to show the release member in a thermal printer, which is an embodiment according to the present invention.

As can be understood from FIG. 11, the above-mentioned release plate 131 is disposed and fixed separately from the thermal head, being in contact with the printed paper 128 on the platen 129 side of the tangent line of platen 129 at print position P and the paper 128 is conveyed on the platen 129 side. Release position A by the release plate 131 is provided on the platen 129 side of tangent line L to release thermal transfer print ribbon 111 from paper 128. Therefore, the ribbon winding force by take-up core 133 is supported by release plate 131 and the push-up force provided by the flexibility of paper 128 is similarly supported by release plate 131 so that those external forces are not applied to thermal head 130.

Since the ribbon release mechanism illustrated in the above-mentioned embodiment supports the ribbon winding force with the release member and the push-up force provided by the flexibility of paper similarly with the release member so that those external forces are not applied to the thermal head, the external force which reduces the pushing force against the platen is not applied to the thermal head and lowering of the print quality is prevented. Although a case in which plate-type release plate 131 is used as a release member is shown in the above-mentioned embodiment, not only a plate-type release member, but also bar-type or other release members can be used.

What is claimed is:

1. A printer having a print ribbon end detecting mechanism comprising:

a supply core;

a print ribbon which is wound onto the supply core;

a paper which is put together with the print ribbon supplied from the supply core;

a print head which is mounted facing a platen and prints on the paper by using the print ribbon when the paper put together with the print ribbon passes between the print head and the platen;

a take-up core which, after printing by the print head, takes up the print ribbon by pulling it off the paper;

a tension member which is in contact with the print ribbon between the supply core and the take-up core and biases the print ribbon in a direction to give tension and which can be rotated in its retracted direction by a ribbon feed force against a biasing force by the tension member when the print ribbon having one end fastened to the supply core runs out;

a shutter member which is supported by the tension member and maintained at a non-detecting position with the print ribbon when there is a print ribbon between the supply core and the take-up core and which can be moved to a detecting position when the print ribbon runs out; and a sensor which operates by the shutter member moved to the detecting position, operates with the tension member rotated in the retracted direction, and detects a ribbon end.

2. A printer having a back tension mechanism comprising:

a supply core;

a print ribbon which is wound onto the supply core;

a paper which is put together with the print ribbon supplied from the supply core;

a print head which is mounted facing a platen and prints on the paper by using the print ribbon when the paper put together with the print ribbon passes between the print head and the platen;

a take-up core which, after printing by the print head, pulls the print ribbon off the paper and takes up the print ribbon;

a tension member which is in contact with the print ribbon between the supply core and the take-up core and biases the print ribbon in a direction to give tension and is rotated in a retracted direction by a ribbon feed force against a biasing force by the tension member when the print ribbon wound on the supply core is fed; and a plate spring which is supported by the tension member and gives a rotational load to the supply core by pushing an end against the supply core and which reduces the rotational load by making the amount of deflection small with the rotation of the tension member in the retracted direction.

3. A printer having a back tension mechanism comprising:

a supply core;

a print ribbon which is wound onto the supply core;

a paper which is put together with the print ribbon supplied from the supply core;

a print head which is mounted facing a platen and prints on the paper by using the print ribbon when the paper put together with the print ribbon passes between the print head and the platen;

a take-up core which, after printing by the print head, pulls the print ribbon off the paper and takes up the print ribbon;

a tension member which is in contact with the print ribbon between the supply core and the take-up core and biases the print ribbon in a direction to give tension and is rotated in a retracted direction by a ribbon feed force against a biasing force by the tension member when the print ribbon wound on the supply core is fed; and a plate spring which is supported by the tension member and gives a rotational load to the supply core by pushing an end against a member which rotates together with the supply core and which reduces the rotational load by making the amount of deflection small with the rotation of the tension member in the retracted direction.

4. A printer having a back tension mechanism comprising:

a supply core;

a roll paper which is wound on the supply core;

a print head which is mounted facing a platen and prints on the roll paper when the roll paper fed from the supply core passes between the print head and the platen;

a take-up core which takes up the roll paper after printing by the print head;

a tension member which is in contact with the roll paper between the supply core and the take-up core and biases the roll paper in a direction to give tension and which is rotated in a retracted direction by a roll paper feed force against a biasing force by the tension member when the roll paper wound on the supply core is fed; and a plate spring which is supported by the tension member and gives a rotational load to the supply core by pushing an end against the supply core and which reduces the rotational load by making the amount of deflection small with the rotation of the tension member in the retracted direction.

5. A printer having a back tension mechanism comprising:

a supply core;

a roll paper which is wound on the supply core;

a print head which is mounted facing a platen and prints on the roll paper when the roll paper fed from the supply core passes between the print head and the platen;

a take-up core which takes up the roll paper after printing by the print head;

a tension member which is in contact with the roll paper between the supply core and the take-up core and biases the roll paper in a direction to give tension and which is rotated in a retracted direction by a roll paper feed force against a biasing force by the tension member when the roll paper wound on the supply core is fed; and a plate spring which is supported by the tension member and gives a rotational load to the supply core by pushing an end against a member which rotates together with the supply core and which reduces the rotational load by making the amount of deflection small with the rotation of the tension member in the retracted direction.

* * * * *